US010446130B1

(12) United States Patent
Shaw

(10) Patent No.: US 10,446,130 B1
(45) Date of Patent: Oct. 15, 2019

(54) STRINGED INSTRUMENT PICKUP WITH MULTIPLE COILS

(71) Applicant: Fender Musical Instruments Corporation, Scottsdale, AZ (US)

(72) Inventor: Timothy P. Shaw, Hendersonville, TN (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 16/057,964

(22) Filed: Aug. 8, 2018

(51) Int. Cl.
*G10H 3/18* (2006.01)
*H01F 27/32* (2006.01)
*H01F 27/28* (2006.01)

(52) U.S. Cl.
CPC ..... *G10H 3/181* (2013.01); *H01F 27/28* (2013.01); *H01F 27/325* (2013.01); *G10H 2220/515* (2013.01)

(58) Field of Classification Search
CPC ..... G10H 3/18; G10H 3/181; G10H 3/182; G10H 2220/515
USPC ..... 84/726, 725
See application file for complete search history.

(56) References Cited

U.S. PATENT DOCUMENTS 3,915,048 A * 10/1975 Stich ..... G10H 3/18 84/728
4,164,163 A * 8/1979 Rhodes ..... G10H 3/182 84/728
4,372,186 A * 2/1983 Aaroe ..... G10H 3/181 84/725
4,524,667 A * 6/1985 Duncan ..... G10H 3/181 84/728
4,809,578 A 3/1989 Lace, Jr.
4,878,412 A * 11/1989 Resnick ..... G10H 3/181 84/726
5,136,918 A 8/1992 Riboloff
5,168,117 A * 12/1992 Anderson ..... G10H 3/181 29/609.1
5,311,806 A 5/1994 Riboloff
5,376,754 A * 12/1994 Stich ..... G10H 3/182 84/728
5,389,731 A * 2/1995 Lace ..... G10H 3/181 84/726
5,391,831 A * 2/1995 Lace ..... G10H 3/181 84/726
5,408,043 A * 4/1995 Lace ..... G10H 3/181 84/726
5,422,432 A * 6/1995 Lace ..... G10H 3/181 84/726
5,530,199 A * 6/1996 Blucher ..... G10H 3/181 84/728
5,789,691 A 8/1998 Stich
6,121,537 A * 9/2000 Pawar ..... G10H 3/182 84/728
6,476,309 B2 * 11/2002 Gaglio ..... G10H 3/181 84/726

(Continued)

*Primary Examiner* — David S Warren
(74) *Attorney, Agent, or Firm* — Hall Estill Attorneys at Law; Tyler J. Mantooth

(57) ABSTRACT

A stringed instrument pickup with multiple selectable coils has at least a bobbin body supporting at least one pole piece, a first coil, and a second coil. The first coil may continuously extend between a first terminal of the bobbin body and a second terminal of the bobbin body while the second coil continuously extends from the second terminal to a third terminal of the bobbin body.

20 Claims, 4 Drawing Sheets

(56) References Cited

U.S. PATENT DOCUMENTS 6,525,258 B1 * 2/2003 Powers ..... G10H 3/181 84/728
6,846,981 B2 * 1/2005 Devers ..... G10H 3/181 84/728
7,189,916 B2 * 3/2007 Kinman ..... G10H 3/181 84/726
7,227,076 B2 * 6/2007 Stich ..... G10H 3/181 84/726
7,982,123 B2 * 7/2011 Mulvany ..... G10H 3/181 84/725
7,994,413 B2 * 8/2011 Salo ..... G10H 3/181 84/726
8,309,836 B1 11/2012 Bolger et al.
8,319,088 B1 * 11/2012 Harari ..... G10H 3/181 84/727
8,802,959 B2 * 8/2014 Mills ..... G10H 3/181 84/726
8,940,993 B1 * 1/2015 Micek ..... G10H 3/186 84/725
9,165,545 B2 * 10/2015 Gelvin ..... G10H 3/181
9,257,112 B2 * 2/2016 Mills ..... G10H 3/181
9,524,710 B2 * 12/2016 Mills ..... G10H 3/181
9,704,464 B1 * 7/2017 Petschulat ..... G10H 3/181
9,747,882 B1 8/2017 Micek
9,818,389 B2 * 11/2017 Beers ..... G10H 3/181
9,837,063 B1 * 12/2017 Feese ..... G10H 3/181
2002/0020281 A1 * 2/2002 Devers ..... G10H 3/181 84/728
2002/0073829 A1 * 6/2002 Gaglio ..... G10H 3/181 84/726
2002/0083819 A1 * 7/2002 Kinman ..... G10H 3/181 84/726
2003/0051596 A1 * 3/2003 Gustafsson ..... G10H 3/181 84/723
2004/0003709 A1 * 1/2004 Kinman ..... G10H 3/181 84/728
2004/0107822 A1 * 6/2004 Olvera ..... G10H 3/182 84/743
2005/0109197 A1 * 5/2005 Garrett ..... G10H 3/182 84/726
2005/0150364 A1 7/2005 Krozack et al.
2005/0150365 A1 * 7/2005 Krozack ..... G10H 3/181 84/726
2006/0112816 A1 * 6/2006 Kinman ..... G10H 3/181 84/728
2006/0156911 A1 * 7/2006 Stich ..... G10H 3/181 84/726
2010/0101399 A1 * 4/2010 Calvet ..... G10H 3/181 84/726
2010/0122623 A1 * 5/2010 Salo ..... G10H 3/181 84/726
2012/0103169 A1 * 5/2012 Lingel ..... G10H 3/08 84/726
2012/0103170 A1 * 5/2012 Kinman ..... G10H 3/181 84/726
2012/0118129 A1 * 5/2012 Jang ..... G10H 3/143 84/726
2013/0239788 A1 * 9/2013 Mills ..... G10H 3/181 84/726
2013/0312591 A1 * 11/2013 Mills ..... G10H 3/181 84/726
2013/0327202 A1 * 12/2013 Mills ..... G10H 3/181 84/726
2014/0202319 A1 * 7/2014 Osborne ..... G10H 3/181 84/728
2014/0245877 A1 * 9/2014 Gelvin ..... G10H 3/181 84/727
2015/0027300 A1 * 1/2015 Wolf ..... G10H 3/181 84/726
2015/0053069 A1 * 2/2015 Heil ..... G10H 3/181 84/726
2015/0199949 A1 * 7/2015 Fishman ..... G10H 3/143 84/726
2015/0379978 A1 * 12/2015 Jang ..... G10H 3/181 84/726
2016/0055841 A1 * 2/2016 Ulbrick ..... G10D 1/085 84/728
2017/0162180 A1 * 6/2017 Beers ..... G10H 3/181
2018/0102121 A1 * 4/2018 Shaw ..... G10H 3/181
2018/0108335 A1 * 4/2018 Cudney ..... G10H 3/143

* cited by examiner

STRINGED INSTRUMENT PICKUP WITH MULTIPLE COILS

SUMMARY

A pickup system utilized in a stringed instrument has, in some embodiments, a bobbin body supporting at least one pole piece, a first coil, and a second coil with the first coil continuously extending between a first terminal of the bobbin body and a second terminal of the bobbin body while the second coil continuously extends from the second terminal to a third terminal of the bobbin body.

In other embodiments, a pickup has a first bobbin body supporting a first pole piece, a first coil, and a second coil. The first coil continuously extends between a first bobbin terminal of the bobbin body and a second bobbin terminal of the first bobbin body while the second coil continuously extends from the second bobbin terminal to a third bobbin terminal of the first bobbin body. A second bobbin body supports a second pole piece and a third coil with the third coil continuously extending from a first bobbin terminal of the second bobbin body to a second bobbin terminal of the second bobbin body. A baseplate is attached to the first and second bobbin bodies to position the first pole piece and second pole piece in vertical alignment with a string.

A pickup, in accordance with various embodiments, has a bobbin body supporting at least one pole piece in vertical alignment with a plurality of strings. A first coil continuously extends from a first terminal of the bobbin body to a second terminal of the bobbin body while a second coil continuously extends from the second terminal to a third terminal of the bobbin body. A third coil continuously extends from a fourth terminal of the bobbin body to a fifth terminal of the bobbin body.

DETAILED DESCRIPTION

Assorted embodiments of the present disclosure are directed to a stringed instrument pickup consisting of multiple coils arranged to provide optimized detection and translation of string motion into electrical signals.

A stringed instrument pickup is a structure that converts movement of a tensioned string into electrical signals. Numerous different pickup structures and configurations have been utilized to customize the manner in which string motion and vibration is captured in an output electrical signal. However, the past arrangements for a single pickup have been static and failed to provide options for a user to customize the outputted electrical signal that are subsequently reproduced as audible sound, such as music.

While numerous different pickups can be positioned on a stringed instrument to provide different selectable characteristics for generating electrical signals, such pickups occupy valuable real estate on a stringed instrument and can have degraded sound quality due to the placement of the pickup(s) relative to the tensioned strings. In addition, positioning a pickup under a different section of the instrument strings can change the sound of the pickup as the harmonic mix of the string's output changes due to where the pickup is physically located relative to the string tensioning bridge of the instrument. By incorporating multiple coils into a single bobbin assembly, a user can select a diverse variety of means for translating string motion into electrical signals with a single pickup. The ability to customize the various coils of a bobbin assembly can additionally provide precise, or vast, alterations to the manner in which electrical signals are generated from string motion, which can optimize musical reproduction without the need for external signal processing, such as a pedal, mixer, or other circuitry.

Accordingly, embodiments of the present disclosure are directed to a single stringed instrument pickup that provides options for a user to customize the manner in which string motion is captured by the pickup. By using multiple different coils in a single bobbin, multiple different coil structures can be employed in a single pickup to provide customized pickup structure. The ability to select different pickup coils provides selectable electrical impedance and magnetic fields that translate string motion and vibration with different output signals that reproduce different sounds.

Figure 1:
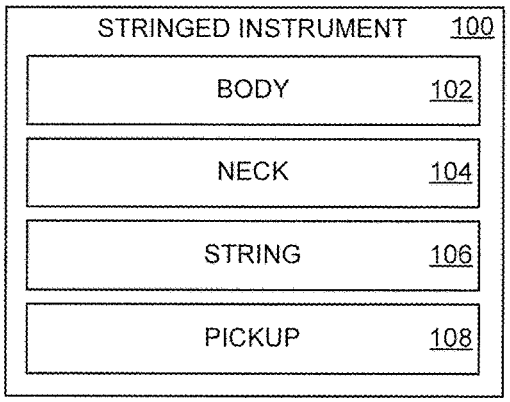
FIG. 1 displays a block representation of an example stringed instrument that may be employed in accordance with various embodiments.

An example stringed instrument 100 is conveyed in FIG. 1 with a body 102 connected to a neck 104. It is noted that the body 102 can be any size, shape, and volume to provide a variety of acoustic characteristics in response to vibration of one or more strings 106 that continuously extend from the neck 104. While the strings 106 can acoustically resonate with the volume of air in the body 102, various embodiments position an electrical pickup 108 proximal the strings 106 to generate electrical signals to represent the acoustic properties of the string 106 motion. Hence, various embodiments are directed to utilizing a pickup in a solid body, or semi-solid body, stringed instrument, such as a guitar.

The pickup 108 is configured to have a magnetic field that is influenced by movement of a string 106 and such magnetic activity is translated to electrical signals by a coil with such electrical signals being subsequently used by other audio equipment, such as an amplifier, speaker, or control board, to produce sound. However, the clarity and acoustic accuracy of stringed instrument pickups 108 have traditionally been imprecise. That is, the generated magnetic field and how it reacts to vibrating strings 108 in assorted configurations have not been able to accurately represent sound as if a user was listening to string motion in-person. For example, a pickup 108 can be constructed to be very accurate for a relatively narrow range of frequencies, but struggle to convey the other frequencies produced by string 106 motion. In another example, a pickup 108 can have relatively high sensitivity, which increases the strength of the representative electrical signal, but at the cost of losing the breadth and depth of the acoustic properties of the moving and/or vibrating string(s) 106.

Figure 2:
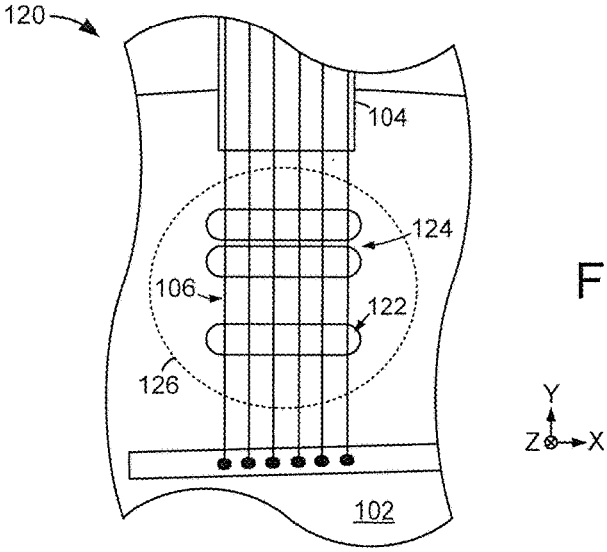
FIG. 2 represents portions of an example guitar stringed instrument in which some embodiment may be employed.

With these issues in mind, many stringed instruments 100 employ multiple pickups 108 in an attempt to provide diversity in the manner in which string 106 motion is captured into electrical signals via magnetic and electrical aspects of a pickup 108. FIG. 2 displays a portion of an example guitar 120 stringed instrument that employs a first pickup 122 and a second pickup 124 to sense movement from one or more strings 106 suspended over a body 102 of the guitar 120. It is contemplated that one or more pickups 122/124 can be utilized in an acoustic, or hollow, body guitar, as represented by segmented sound hole 126. However, assorted embodiments are directed to a pickup secured to a solid, or semi-hollow, guitar body 102.

With the implementation of multiple pickups 122/124 into a guitar 120 a user can select one or more of the pickups 122/124 to be active while playing the strings 106. For example, a selector, such as a button knob, lever, or switch, can be located on the guitar 120 to allow activation of a single pickup 122 or multiple pickups 122/124 concurrently. In the non-limiting example shown in FIG. 2, a single coil pickup 122 is complemented by a humbucking pickup 124 that provide different electrical and magnetic characteristics that translate into unique reproduced sound from the vibrating strings 106. It is noted that two, or more single coil pickups with different configurations and/or acoustic capturing characteristics can alternatively be used.

Although any number, and type, of pickup can be employed in a single guitar 120 the magnetic signature and electrical operation of pickups can be degraded if the pickups are positioned in close physical proximity. Thus, the physical size of the area under the strings 106 can limit how many pickups can be utilized to provide acoustic options for a user.

Figure 3:
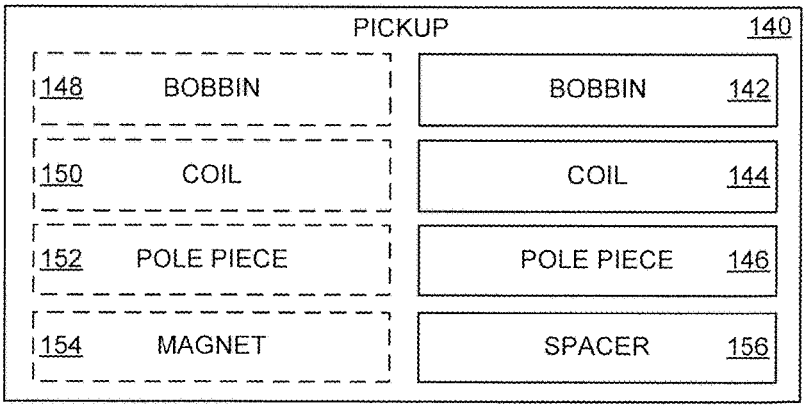
FIG. 3 depicts a block representation of an example pickup capable of being used in the stringed instruments of FIGS. 1 and 2 in accordance with some embodiments.

Accordingly, assorted embodiments are directed to a single pickup that is configured with multiple selectable coils that provide greater electrical, magnetic, and acoustic control to a guitar user. FIG. 3 is a block representation of an example pickup 140 that can be utilized in a stringed instrument, such as a guitar, cello, violin, banjo, or bass. The pickup 140 has a bobbin 142 that positions a coil 144 of electrically conductive wire, such as copper, iron, silver, or gold, to surround a number of pole piece 146. It is contemplated that the pole piece 146 are constructed of a ferrous material, such as iron or steel, with one pole piece 146 is positioned proximal to, and in vertical alignment with, each string of the instrument, as shown in FIG. 2. In another embodiment, a single ferrous bar, or laminated ferrous structure, may continuously extend below, and in vertical alignment with, all the strings of an instrument. Other embodiments may replace a ferrous pole piece, or ferrous bars, with one or more magnets with customized magnetic properties, such as strength and coercivity.

In a humbucking configuration, as shown by segmented boxes, has a second bobbin 148 that separates and positions pole pieces 150 from a coil 152. One or more magnets 154 can be placed between the bobbins 142/148, sometimes in combination with one or more spacers, or shims, 156 so that the magnetic polarity of one coil 144 is the opposite of the other coil 152 and the bobbin assemblies 142/148 are out-of-phase. It is contemplated that individual bobbins 142/148 of a humbucker pickup configuration can be selected. As such, a pickup 140 can be configured to allow each bobbin 142/148 to be a combined single pickup or selectable single coil pickups to sense motion of adjacent string(s) 106 in different ways.

Figure 4:
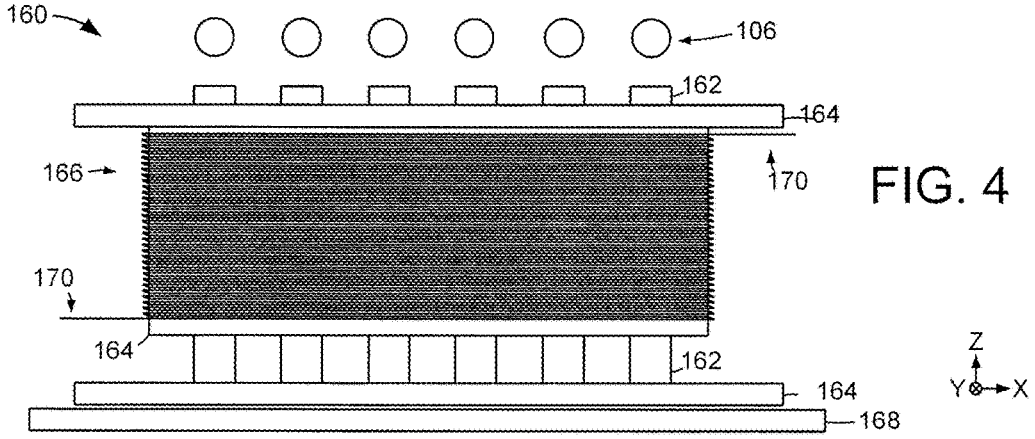
FIG. 4 is a partially exploded line representation of portions of an example pickup arranged in accordance with assorted embodiments.

FIG. 4 illustrates a partially exploded line representation of portions of an example stringed instrument pickup 160 that is arranged in accordance with various embodiments. The exploded aspects of the pickup 160 show how pole pieces 162 are secured within a bobbin 164 so that each 162 is proximal to, and separated from, a string 106 and a coil 166. The coil 166 consists of a continuous electrical wire that is wrapped continuously around the periphery of the bobbin 164 a predetermined number of times, such as 5000, 5500, or 2500 turns at a uniform tension around the perimeter of a coil region that is less than all of the bobbin 164.

Figure 5:
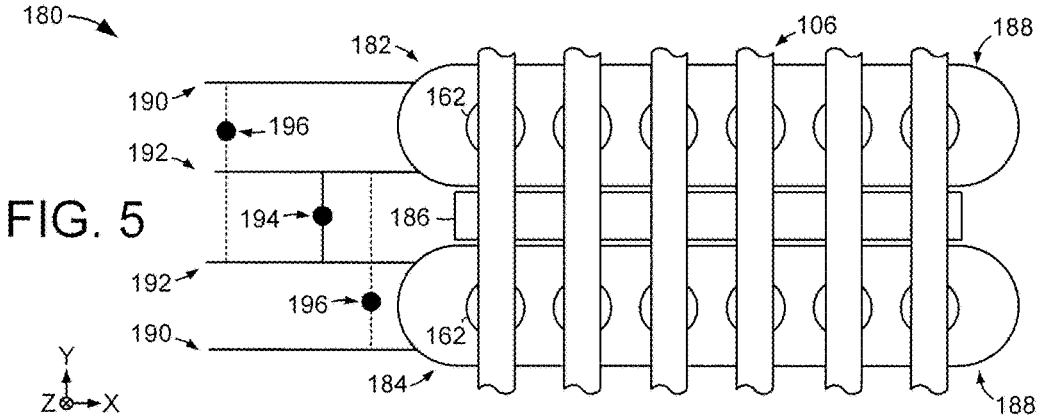
FIG. 5 conveys a top view line representation of portions of an example pickup constructed and operated in accordance with some embodiments.

The bobbin 164, as shown, can be secured to a baseplate 168 that can provide structural rigidity and electrical contact terminals for the respective ends 170 of the coil 166. For instance, a positive end and negative end of the coil 166 can be attached to the baseplate 168 to allow for efficient and reliable electrical connections to a selector and/or output, such as a cable jack. FIG. 5 displays a top view line representation of an example humbucking pickup 180 that is wired in various configurations to provide different acoustic impressions from vibrating string(s) 106. The pickup 180 has a first bobbin 182 separated from a second bobbin 184 by a magnet structure 186.

Each bobbin 182/184 has a single electrically conductive coil 188, in the non-limiting example of FIG. 5, that consists of a continuous wire that has a first end 190 and a second end 192. By connecting the second end 192 of the coil 188 of the first bobbin 182 to the first end 190 of coil 188 of the second bobbin 184, as represented by solid terminal 194, the coils 188 are connected in series and the electrical signals produced by the pickup 180 will generate different streams of electrical signals in response to string motion due to the impedance of the aggregate total of the coils 188. It is contemplated that such streams of electrical signals can have more prominent low and midrange audible frequencies, attenuated frequencies, and otherwise altered digital representation of what an in-person human ear would hear from the string motion.

Connecting the first ends 190 of each coil 188 and the second ends 192 of each coil 188, as represented by segmented terminals 196, provides a parallel wiring configuration that produces a different magnetic field than the series wiring configuration, which can produce different sound characteristics when a generated stream of electrical signals is outputted as sound, such as more prominent higher audible frequencies. While it is contemplated that a selector can be connected to the pickup 180 to allow for activation of either series or parallel wiring configuration, the ability to select two different magnetic fields for a pickup 180 with two bobbins 182/184 and coils 188 is relatively expensive in terms of physical size. Accordingly, various embodiments are directed to a coil and bobbin assembly that provides more magnetic field options, which corresponds with more diversity of how string motion is captured as a stream of electrical signals, for a user in either in a single bobbin pickup or a humbucking pickup.

Figure 6:
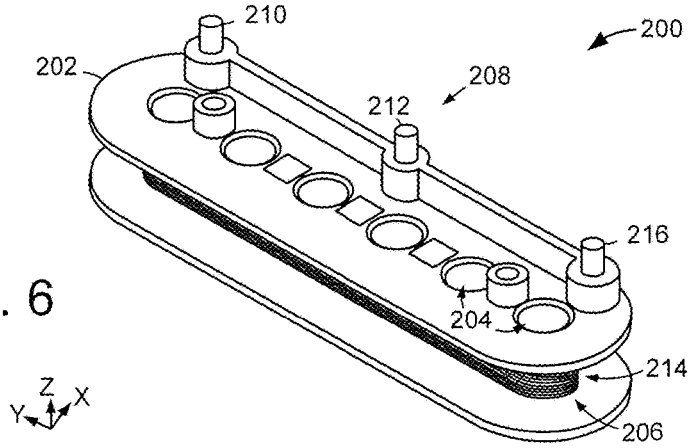
FIG. 6 illustrates a line representation of portions of an example bobbin assembly that can be utilized in a pickup in accordance with various embodiments.

FIG. 6 conveys a line representation of an example bobbin assembly 200 configured in accordance with some embodiments. The bobbin assembly 200 has a single bobbin body 202 that physically contacts and supports a plurality of string pole pieces 204, wound wire 206, and a plurality of electrical wire terminals 208. It is contemplated that the bobbin body 202 is a unitary component or an assembly of multiple pieces that is not electrically or magnetically conductive.

Each pole piece 204 is magnetically conductive and can be electrically separated, or electrically connected to, current flowing through the electrically conductive wire. In some embodiments, the coil comprising of the wound wire 206 physically contacts one or more of the pole pieces 204.

Although the wound wire 206 may be continuous to define a single coil of a predetermined number of turns, such as 2500 or 5000 circumferential passes completely around the bobbin body 202, multiple coils can be provided by the bobbin assembly 200 by connecting different ends of wire 206 to the respective terminals. For instance, a first wire 206 can continuously extend from a first electrically conductive terminal 210 to a second electrically conductive terminal 212 to form a first coil and a second wire 214 can continuously extend from the second terminal 212 to third terminal 216 to form a second coil. Hence, the single bobbin body 202 concurrently supports multiple wire coils that can be independently, and concurrently, activated via the terminals 210/212/216.

With the bobbin body 202 sporting multiple selectable coils, the assembly 202 provides increased signal generation, impedance, and magnetic field options without taking up valuable real estate in an instrument body. It is noted that the bobbin assembly 200 can be constructed with more than two selectable coils. For instance, three coils can be activated via four separate terminals or five coils can be activated via six terminals. It is contemplated that a tap wire can extend from a terminal 208 to a tap in the wire 206/214 instead of having multiple wire ends connected to a common terminal.

Figure 7:
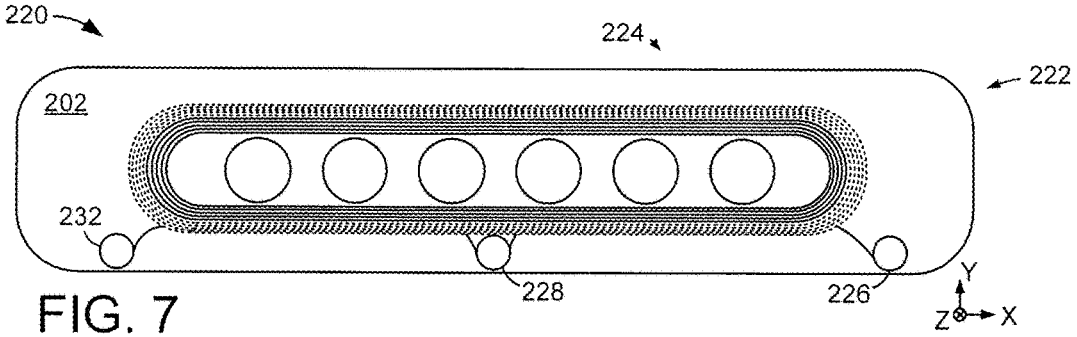
FIG. 7 shows a top view line representation of portions of an example bobbin assembly configured in accordance with assorted embodiments.

FIG. 7 is a top view line representation of portions of an example bobbin assembly 220 that employs multiple concentric wire coils 222 and 224 in accordance with assorted embodiments. A first coil 222, as shown by solid lines, is wound about a center section 224 of the bobbin body 202 and is connected between two separate terminals 226 and 228. A second coil 230, as shown by segmented line, is wound in physical contact with the first coil 222 and is connected between two separate terminals 228 and 232, which may, or may not, be connected to the first coil 222. The respective coils 222/224 can be configured to have a matching, or dissimilar, impedance that corresponds with the length of wire extending between terminals 208. As such, the coils 222/224 can have different, or matching, lengths that correspond with the number of turns about the bobbin body 202.

It is contemplated that the coils 222/224 may be constructed of different materials, wire gauges, or electrically conducting properties. As a non-limiting example, a first coil 222 has 5000 turns and is constructed of copper while the second coil 224 has 2000 turns and is constructed of silver to provide different electrical impedances for selection by a user. The presence of multiple different coils in a single bobbin assembly 220 allows at least four configurable impedances, and corresponding magnetic fields, responding to instrument string 106 motion. That is, a user can select the first coil 222 alone, second coil 224 alone, the coils 222/224 connected in series, or the coils 222/224 connected in parallel via the various terminals provided by the bobbin body 202 to provide differing manners of translating string 106 motion into a stream of electrical signals.

Figure 8:
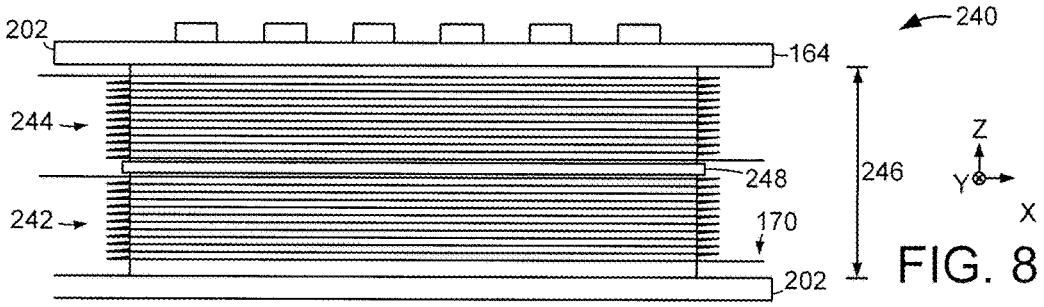
FIG. 8 displays portions of an example bobbin assembly that may be incorporated into a stringed instrument pickup.

FIG. 8 depicts a line representation of portions of another example bobbin assembly 230 arranged with multiple coils 242 and 244 in accordance with some embodiments. As shown, a first coil 242 is wrapped around a first half of the thickness 246 of the bobbin body 202 while a second coil 244 is wrapped around a second half of the body thickness 246. By physically separating the coils 242/244 on different portions of the bobbin thickness 246 with a spacer 248, such as a ridge, protrusion, or other physical stop, the magnetic field and resulting relationship with adjacent string 106 motion that generates electrical signals can be different than if the coils 242/244 physically contacted each other, such as the example embodiment of assembly 220.

The physical separation of coils 242/244 can correspond with matching coil configurations. For instance, the coils 242/244 can be constructed of the same material and wrapped about the body 202 for a matching number of turns, at least within a range of tolerance, such as within 5% of the overall amount of turns or 2% of the overall length of wound wire. The very close, or exact, construction of the coils 242/244 can provide a greater range of customizable acoustic properties due to the greater variance in electrical impedance than if there was a smaller overall length of wound wire for the multiple coils 242/244. It is contemplated that the wire can pass through internal cavities in the bobbin body 202, or otherwise be electrically and/or magnetically insulated from the wire of the other coil, to reach a terminal 226/228/232 positioned on the bottom of the body 202, which prevents the coils from physically touching or interfering (electrically and/or magnetically) with one another during activation.

Figure 9A:
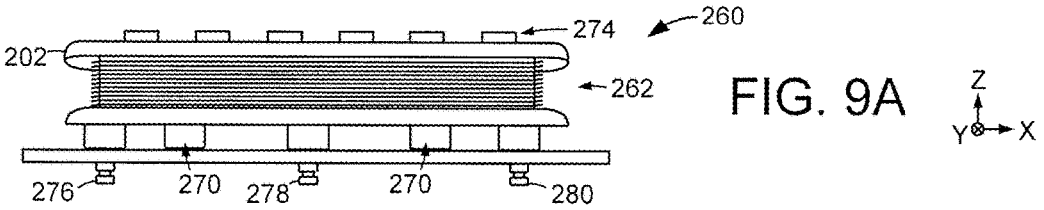
FIGS. 9A-9C represent an example stringed instrument pickup arranged in accordance with some embodiments.
Figure 9B:
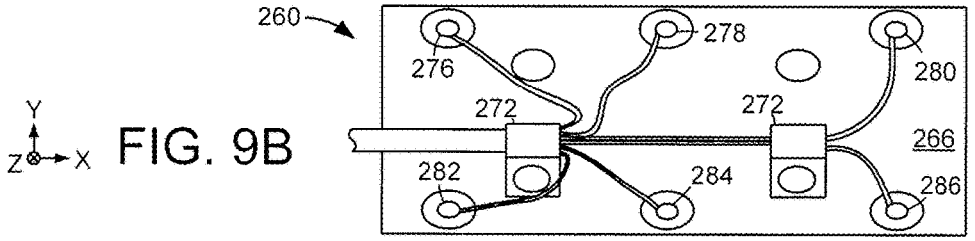
Figure 9C:
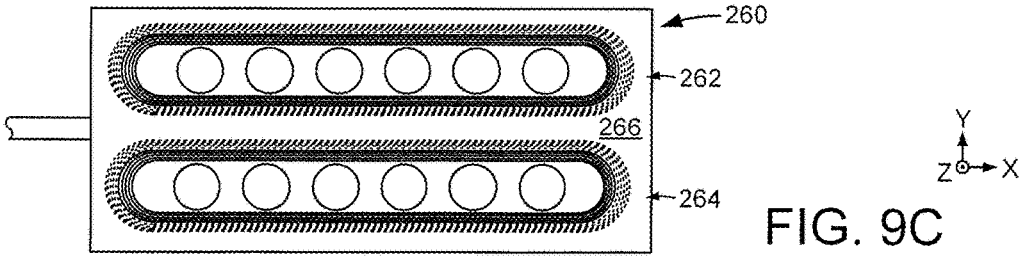

A bobbin assembly with multiple selectable coils can be employed in a stringed instrument alone. However, some embodiments pair one or more bobbin assemblies together with additional structure. FIGS. 9A-9C respectively convey line representations of various aspects of an example instrument pickup 260 arranged for humbucking operation, although non-humbucking operation are possible when a single bobbin assembly is mounted to a stringed instrument. The pickup 260 has a first bobbin assembly 262, as shown in the side view of FIG. 9A, and a second bobbin assembly 264, as shown in FIG. 9B, that each physically attach to a common baseplate 266. The baseplate 266 provides increased structural rigidity and electrical connection integrity compared to if a bobbin assembly 262/264 was mounted to an instrument body alone.

The bottom view of the pickup 260 shown in FIG. 9B illustrates how the baseplate 266 may also provide electrical interconnection pathways to connect directly to the terminals extending from the respective bobbin assemblies 262/264 or to various plate terminals 268 that physically contact the terminals of the respective bobbin assemblies 262/264. That is, the baseplate 266 can consist of its own terminals 268 that contact the bobbin terminals or can consist of apertures through which the bobbin terminals extend when mounted to the baseplate 266.

In the non-limiting embodiment where the baseplate 266 comprises plate terminals 268, the respective plate terminals 268 can physically contact the respective bobbin terminals 208. Regardless of whether the baseplate 266 consists of plate terminals 268, the physical separation of terminals corresponding to different coils allows one or more coils of the bobbin assemblies 262/264 to be activated via electrical interconnections that are fixed in place by at least one support 270. It is noted that in operation the respective bobbin assemblies 262/264 will each be rotated so that the electrical terminals physically contact the corresponding plate terminals 268 and the pole pieces 272 face and are vertically aligned with instrument strings 106, as generally shown in FIGS. 4 & 5.

The respective bobbin assemblies 262/264 can be secured to the baseplate 266 with one or more fasteners, such as rivets, screws, pins, tabs, or retainers. It is contemplated that one or more bobbin assemblies 262/264 are mounted atop at least one spring, or other suspension, that dampens movement and positioning the pole pieces 272 a predetermined distance from the respective instrument strings. The baseplate 266 may also be mounted to the body, or neck, of a stringed instrument with one or more fasteners and may employ a motion, and/or vibration, dampening suspension.

The assorted views of the pickup 260 shown in FIGS. 9A-9C illustrate how the respective bobbin assemblies 262/264 attach to the baseplate 266 to provide a single, unitary pickup structure. The top view of FIG. 9C shows how each bobbin assembly 262/264 can comprise multiple concentric coils of electrically conductive wire, as represented solid and segmented wire paths around the respective bobbin bodies 202.

Once the pickup is assembled with the bobbin assemblies 262/264 mounted to the baseplate 266 with the various plate terminals 268 electrically connected to the bobbin terminals 208, a user can selectively activate a diverse variety of coils that correspond with different electrical impedances, magnetic fields, and acoustic characteristics captured in electrical signals outputted by the pickup 260. In the non-limiting example pickup 260 configuration shown in FIG. 9B, terminal 276 is a start of a first coil of the first bobbin assembly 262, terminal 278 is connected to the first coil and a second coil of the first bobbin assembly 262, and terminal 280 is the end of the second coil of the first bobbin assembly 262. Similarly, terminal 282 is a start of a first coil of the second bobbin assembly 264, terminal 284 is the end of the first coil and the beginning of a second coil of the second bobbin assembly 264, and terminal 286 is the end of the second coil of the second bobbin assembly 264.

Figure 10A:
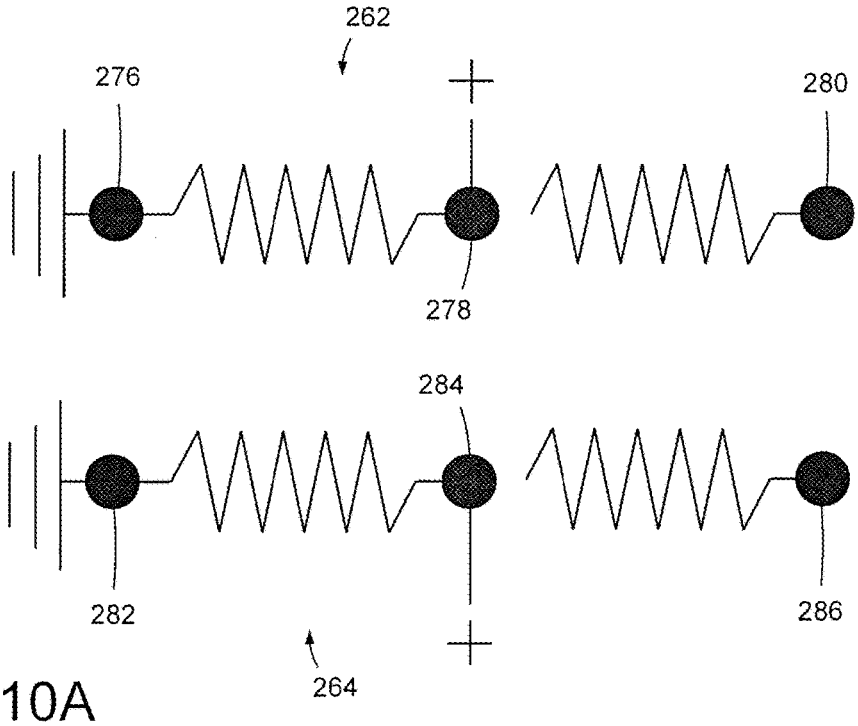
FIGS. 10A & 10B respectively provide electrically operational schematics of an example stringed instrument pickup configured in accordance with various embodiments.
Figure 10B:
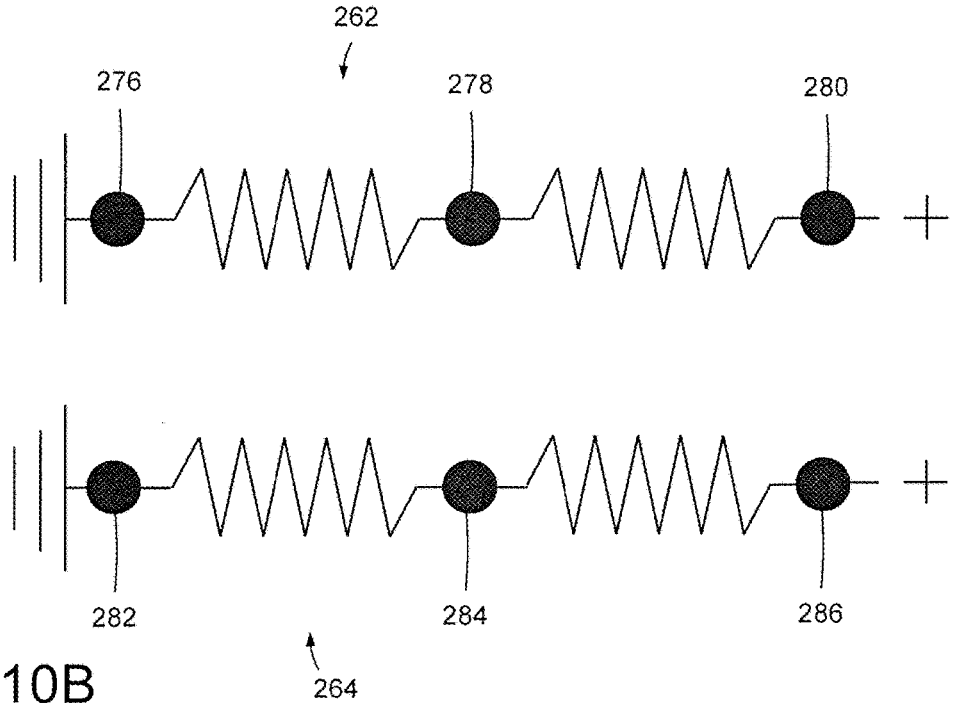

By selecting any two of the three plate terminals 276/278/280 corresponding to the first bobbin assembly 262, or terminals 282/284/286 corresponding to the second bobbin assembly 264, different numbers of coils, and lengths of conducting wire acting as an electrical resistor, receive electrical current that produces different magnetic fields that respond differently to vibrations and movement of adjacent strings 106 to produce different acoustic characteristics in the generated electrical signals. FIGS. 10A and 10B respectively display schematics of example operation of the humbucking pickup 260 of FIGS. 9A-9C. In FIG. 10A, a first bobbin assembly 262 activates a single coil between two plate terminals 274 and 276 and a single coil of the second bobbin assembly 264 is activated by selecting plate terminals 280 and 282.

By selecting plate terminals 274 and 278, both coils of the first bobbin assembly 262 are activated with greater electrical resistance provided by the increased number of wire windings of the second coil. The exemplary electrical configuration of FIG. 10B conveys how multiple coils of each bobbin assembly 262/264 are concurrently activated by selecting plate terminals 274, 278, 280, and 284. Hence, the various plate terminals 268 in association with the assorted bobbin terminals 208 allows for selective activation of one or more coils in each connected bobbin assembly 262/264.

As a result of the dual coil bobbin assemblies 262/264, nine different pickup configurations can be selected, each of which has different impedance, magnetic, and acoustic properties that provide diverse acoustic generation to a user without adding nine separate single-coil bobbin assemblies to an instrument. It is noted that the selection of various coils can provide matching, or mismatching, electrical impedances between the bobbin assemblies 262/264. The ability to selectively utilize different electrical impedances, such as impedances differences of 100, 500, 1000, or more ohms, allows for a broad range of useful sonic properties from a single pickup 260.

In some embodiments, a single bobbin assembly is utilized without a humbucking counterpart bobbin assembly. Such a configuration may, or may not, employ a baseplate 266, but can provide selective activation of different wound coils that correspond with different magnetic properties that translate to different acoustic characteristics. Regardless of the humbucking configuration of a pickup, the use of a bobbin assembly with more than one coil allows for precise, or vast, alterations to the manner in which string movement and vibration translates to outputted electrical signals depending on the structural configuration of the coils.

Even though numerous characteristics and advantages of the various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An apparatus comprising a bobbin body supporting at least one pole piece, a first coil, and a second coil, the first coil continuously extending between a first terminal of the bobbin body and a second terminal of the bobbin body, the second coil continuously extending from the second terminal to a third terminal of the bobbin body, each terminal of the bobbin body being physically selectable individually, each coil being individually selectable, the first coil concentrically contacting the second coil, the second coil separated from the bobbin body by the first coil.

2. The apparatus of claim 1, wherein the bobbin body is mounted on a body of a stringed instrument.

3. The apparatus of claim 1, wherein the at least one pole piece is positioned proximal to, separated from, and vertically aligned with a string of a stringed instrument.

4. The apparatus of claim 1, wherein each coil comprises a single electrically conducive wire wrapped around the bobbin body.

5. The apparatus of claim 4, wherein the first coil is wrapped around the bobbin body a different number of times than the second coil.

6. The apparatus of claim 4, wherein the first coil has a different electrical impedance than the second coil.

7. The apparatus of claim 1, wherein the first coil comprises a first material and the second coil comprises a second material, the first and second materials being different.

8. The apparatus of claim 1, wherein the first coil comprises a first wire having a first gauge and the second coil comprises a second wire having a second gauge, the first and second gauges being different.

9. The apparatus of claim 1, wherein the first coil comprises a first wire and the second coil comprises a second wire, the first wire having a different length than the second wire.

10. The apparatus of claim 1, wherein each terminal is integrated into the bobbin body.

11. A pickup comprising:

a first bobbin body supporting a first pole piece, a first coil, and a second coil, the first coil continuously extending between a first bobbin terminal of the bobbin body and a second bobbin terminal of the first bobbin body, the second coil continuously extending from the second bobbin terminal to a third bobbin terminal of the first bobbin body, each terminal of the bobbin body being physically selectable individually, each coil being individually selectable, the first coil concentrically contacting the second coil, the first coil separated from the first bobbin body by the first coil;

a second bobbin body supporting a second pole piece and a third coil, the third coil continuously extending from a first bobbin terminal of the second bobbin body to a second bobbin terminal of the second bobbin body; and a baseplate attached to the first bobbin body and the second bobbin body to position the first pole piece and second pole piece in vertical alignment with a string.

12. The pickup of claim 11, wherein a magnet extends between the first bobbin body and the second bobbin body.

13. The pickup of claim 11, wherein the respective bobbin terminals are each attached to separate electrical interconnections.

14. The pickup of claim 13, wherein the separate electrical interconnections are secured in place by at least one support of the baseplate.

15. The pickup of claim 11, wherein the respective bobbin terminals electrically contact corresponding plate terminals of the baseplate.

16. The pickup of claim 11, wherein the first coil and the third coil have matching electrical impedances.

17. The pickup of claim 16, wherein the first and second coils are connected in series and have an aggregate electrical impedance that differs from the electrical impedance of the third coil.

18. A system comprising:

a bobbin body supporting a plurality of pole pieces in vertical alignment with a plurality of strings;

a first coil continuously extending from a first terminal of the bobbin body to a second terminal of the bobbin body;

a second coil concentrically wound atop the first coil, the second coil separated from the bobbin body by the first coil, the second coil continuously extending from the second terminal to a third terminal of the bobbin body;

a third coil continuously extending from a fourth terminal of the bobbin body to a fifth terminal of the bobbin body, each terminal of the bobbin body being physically selectable individually, each coil being individually selectable.

19. The system of claim 18, wherein the first coil and second coil are connected in series via the second terminal.

20. The system of claim 18, wherein the third coil is connected in parallel with the first coil.

* * * * *